US007416522B2

(12) United States Patent
Schmieder

(10) Patent No.: US 7,416,522 B2
(45) Date of Patent: Aug. 26, 2008

(54) FOLDING DRUM OF A FOLDER OF A PRINTING PRESS

(75) Inventor: Frank Schmieder, Plauen (DE)

(73) Assignee: Manroland AG, Offenbach am Main (DE)

( * ) Notice: Subject to any disclaimer, the term of this patent is extended or adjusted under 35 U.S.C. 154(b) by 0 days.

(21) Appl. No.: 11/494,220

(22) Filed: Jul. 27, 2006

(65) Prior Publication Data

US 2007/0037683 A1 Feb. 15, 2007

(30) Foreign Application Priority Data

Aug. 1, 2005 (DE) ..... 10 2005 036 612

(51) Int. Cl.
*B31F 1/10* (2006.01)

(52) U.S. Cl. ..... 493/425; 493/424

(58) Field of Classification Search ..... 493/424, 493/425, 426, 427, 428
See application file for complete search history.

(56) References Cited

U.S. PATENT DOCUMENTS 5,741,209 A 4/1998 Hillebrand et al.
5,873,808 A * 2/1999 Piller et al. ..... 493/425
6,688,224 B2 * 2/2004 Herda et al. ..... 493/425
2005/0003943 A1 1/2005 Schalk

FOREIGN PATENT DOCUMENTS

DE 103 14 945 B4 3/2005
DE 195 11 054 C2 3/2005

* cited by examiner

*Primary Examiner*—Louis K Huynh
(74) *Attorney, Agent, or Firm*—Cohen Pontani Lieberman & Pavane LLP

(57) ABSTRACT

A folding drum includes folding-drum side walls lying opposite one another, journals lying opposite one another and acting on the folding-drum side walls, a frame on which the folding drum is mounted rotatably via the folding-drum side walls and the journals, a folding-blade spindle arranged between the folding-drum side walls, at least one folding blade arranged on the folding-blade spindle, roller bearings for rotatably mounting the folding-blade spindle, and at least one device positioned laterally next to the roller bearings and serving to mount the folding-blade spindle in order to introduce a radial force into the folding-blade spindle and therefore to prestress the respective roller bearing in a radial direction.

8 Claims, 2 Drawing Sheets

FOLDING DRUM OF A FOLDER OF A PRINTING PRESS

BACKGROUND OF THE INVENTION

The invention relates to a folding drum of a folder of a printing press.

Folders of printing presses serve to form folds on printed printing materials. In folders which are known from the prior art, a web-shaped printing material is usually guided first of all through a first longitudinal folding unit which is configured as a folding former in order thus to form a first longitudinal fold on the web-shaped printing material which is preferably not yet severed. Starting from the first longitudinal folding unit or from the folding former, the web-shaped printing material is guided in the direction of a crossfolding unit which comprises a cutting-knife cylinder, a folding-blade cylinder, a folding-jaw cylinder and optionally a gripper cylinder. In the region of the cutting-knife cylinder, copies are severed from the web-shaped printing material, which copies are moved in the direction of the folding-jaw cylinder with the aid of the folding-blade cylinder. The copies which are severed at the cutting-knife cylinder and are moved in the direction of the folding-jaw cylinder by the folding-blade cylinder are transferred to the folding-jaw cylinder with the formation of a first crossfold by the folding-blade cylinder. Further, second crossfolds can be formed between the folding-jaw cylinder and the gripper cylinder which interacts with the folding-jaw cylinder. Starting from the crossfolding unit, the copies which are provided thus with a longitudinal fold and with at least one crossfold pass into the region of a second longitudinal folding unit which usually comprises folding drums. Second longitudinal folds which extend parallel to the longitudinal fold which is formed in the first longitudinal folding unit are formed on the already pre-folded copies with the aid of the folding drums which in each case comprise a folding blade. A folding drum of this type is known from US Patent Application Publication No. 2005/0003943 A1.

The folding drum which is known from US 2005/0003943 A1 has two folding-drum side walls which lie opposite one another and on which journals act, it being possible for the folding drum to be mounted rotatably on a frame or framework via the journals. A folding-blade shaft or folding-blade spindle which is mounted rotatably via self-aligning roller bearings which are positioned in the region of the folding-drum side walls extends between the folding-drum side walls. The use of roller bearings of this type is necessary to absorb the forces which occur during operation of the folding drum, namely the process force, weight and centrifugal force. However, roller bearings require a relatively great minimum load which cannot be maintained, in particular, in the lower and medium rotational-speed ranges of the folding drum. In the event of sudden load drops, sliding movements between the rollers and the raceway of the roller bearings can be formed as a result of the mass moment of inertia and the pronounced reduction in the forces which act in the radial direction, which sliding movements can lead to increased bearing wear.

SUMMARY OF THE INVENTION

An object of the present invention is to provide a novel folding drum of a folder of a printing press. According to a preferred embodiment of the invention, the folding drum comprises folding-drum side walls lying opposite one another, journals lying opposite one another and acting on the folding-drum side walls, a frame on which the folding drum is mounted rotatably via the folding-drum side walls and the journals, a folding-blade spindle arranged between the folding-drum side walls, at least one folding blade arranged on the folding-blade spindle, roller bearings for rotatably mounting the folding-blade spindle, and at least one device positioned laterally next to the roller bearings and serving to mount the folding-blade spindle in order to introduce a radial force into the folding-blade spindle and therefore to prestress the respective roller bearing in a radial direction.

Thus, it is proposed to introduce a radial force into the folding-blade spindle and, as a result, to prestress the roller bearings in the radial direction which serve to mount the folding-blade spindle. The prestressing of the roller bearings prevents a sliding movement between the rollers and the raceway of the roller bearings, as a result of which bearing wear can be reduced considerably in the lower rotational-speed range and in the event of sudden load drops.

Here, the magnitude of the radial force which is to be introduced into the folding-blade spindle and therefore the magnitude of the radial prestress of the roller bearings is preferably dimensioned such that the sum of all the active forces and moments prevents a reversal of the direction of the bearing forces. As a result, running through the bearing play can be avoided, as a result of which firstly the play in a mechanism of the folding drum can be reduced, and as a result of which secondly the folding accuracy can be increased.

According to a preferred embodiment of the invention, each device for introducing the radial force into the folding-blade spindle comprises a ball bearing which acts on the folding-blade spindle and a spring element which acts on the ball bearing, the ball bearing being arranged together with the respective roller bearing in a bearing housing in such a way that the roller bearing is supported axially and radially on the bearing housing and the ball bearing which is positioned laterally next to the respective roller bearing is arranged in the bearing housing without axial and radial support on the latter.

The spring element preferably acts on the respective ball bearing with a ring which surrounds the ball bearing being arranged in between, it being possible to set the radial force which is provided by the spring element independently of the rotational speed via a prestressing element which acts on the spring element.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
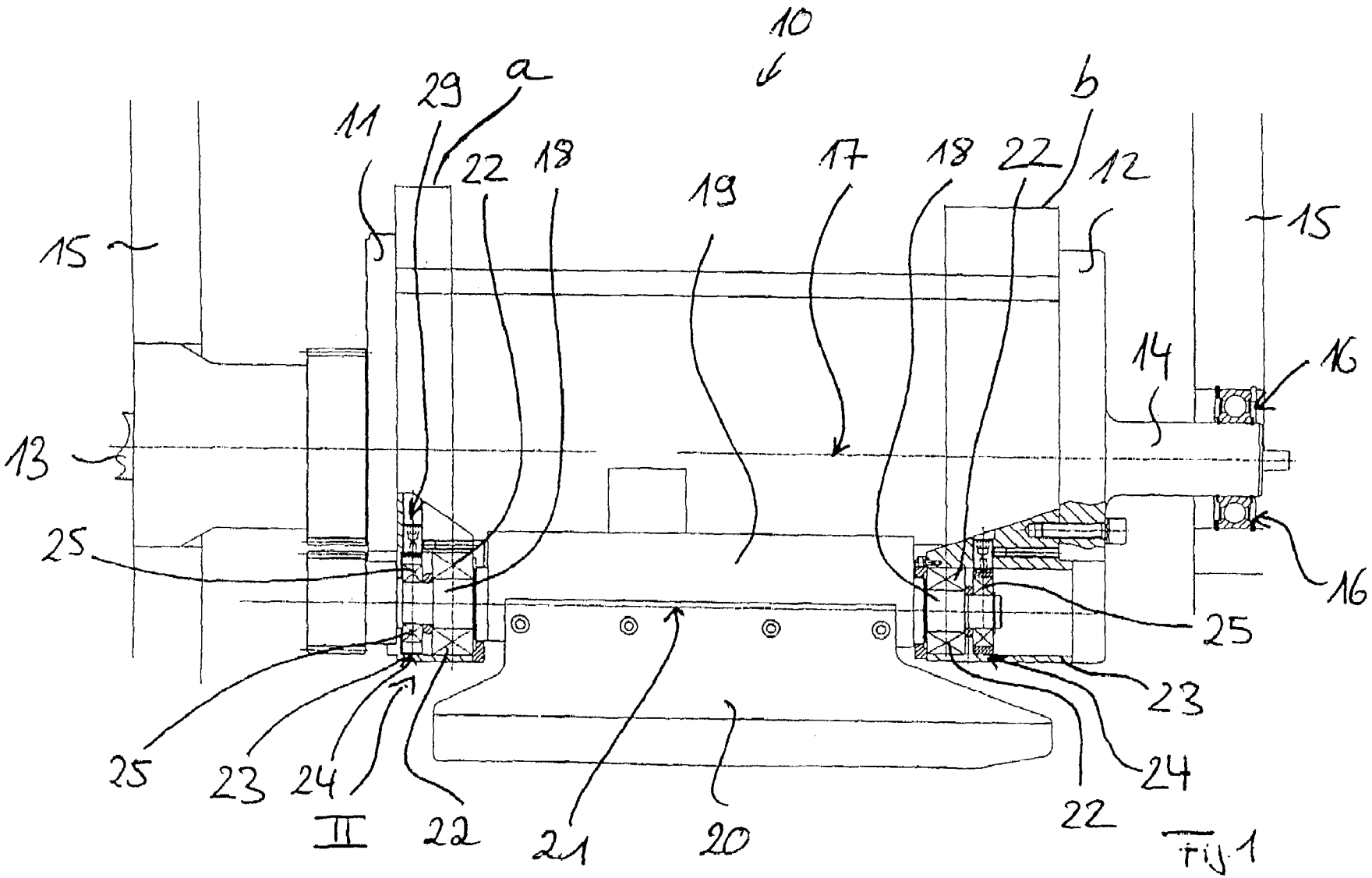
FIG. 1 is a partial cross-sectional view of a folding drum of a folder of a printing press according to an embodiment of the present invention.

FIG. 1 shows a folding drum 10 according to the invention of a folder of a web-fed rotary press, the folding drum 10 serving to form what are known as second longitudinal folds on copies which are severed from a web-shaped printing material and are pre-folded with a first longitudinal fold and at least one crossfold.

The folding drum 10 which is shown in FIG. 1 has two folding-drum side walls 11 and 12 which lie opposite one another. Journals 13 and 14 act laterally on the folding-drum side walls 11 and 12, the folding drum 10 being mounted rotatably in a framework or frame 15 via the journals 13 and 14. The bearings 16 which are shown in FIG. 1 act on the frame 15 with a stationary bearing ring and on the journals 13 and 14 with a rotating bearing ring, and serve to mount the folding drum 10 rotatably on the frame 15. As a result, the entire folding drum 10 can be rotated about a longitudinal axis 17.

A folding-blade spindle 18 is positioned between the folding-drum side walls 11 and 12, a folding blade 20 being fastened to the folding-blade spindle 18 via a folding-blade carrier 19 in the exemplary embodiment shown. The folding-blade spindle 18 can be rotated about a longitudinal axis 21 extending parallel to the longitudinal axis 17, about which the entire folding drum 10 can be rotated. It is to be noted at this point that the rotational movements about the two longitudinal axes 17 and 21 preferably take place at different rotational speeds, the rotational speed of the folding-blade spindle 18 about the longitudinal axis 21 preferably being twice as fast as the rotational speed of the entire folding drum 10 about the longitudinal axis 17.

The folding-blade spindle 18 is mounted rotatably at lateral ends via roller bearings 22, the roller bearings 22 being positioned in a bearing housing 23. As can be gathered, in particular, from FIG. 2, the respective roller bearing 22 is supported on the bearing housing 23 in the axial direction and in the radial direction. The roller bearings 22 are preferably configured as self-aligning roller bearings.

In the context of the present invention, it is proposed then that in each case at least one device 24 is positioned laterally next to the roller bearings 22, in order to introduce a radial force into the folding-blade spindle 18 and therefore to prestress the roller bearings 22 in the radial direction. Undershooting of the minimum loading for the roller bearings 22 can be avoided as a result of the radial prestressing of the roller bearings 22, in particular in the lower rotational-speed range of the folding drum 10 and in the event of a sudden load drop, with the result that no slippage or sliding can be formed between the rollers and the raceway of the roller bearings 22. As a result, wear of the roller bearings 22 is minimized.

Here, the magnitude of the radial prestressing force is preferably dimensioned in such a way that the sum of all the active forces and moments does not permit a change in the direction of the bearing forces of the roller bearings 22, with the result that a bearing play is not run through.

The devices 24 which are positioned at the sides of the two roller bearings 22 and serve to introduce the radial force into the folding-blade spindle 18 and therefore the radial prestress of the roller bearings 22 comprise in each case a ball bearing 25 and a spring element 26. The ball bearings 25 are preferably configured as deep-groove ball bearings and act on the folding-blade spindle 18. The spring element 26 acts on the ball bearing 25 with a ring 27 being arranged in between, the ring 27 surrounding the respective ball bearing 25 and having a pocket radially on the outside, in which pocket the spring element 26 is accommodated.

Figure 2:
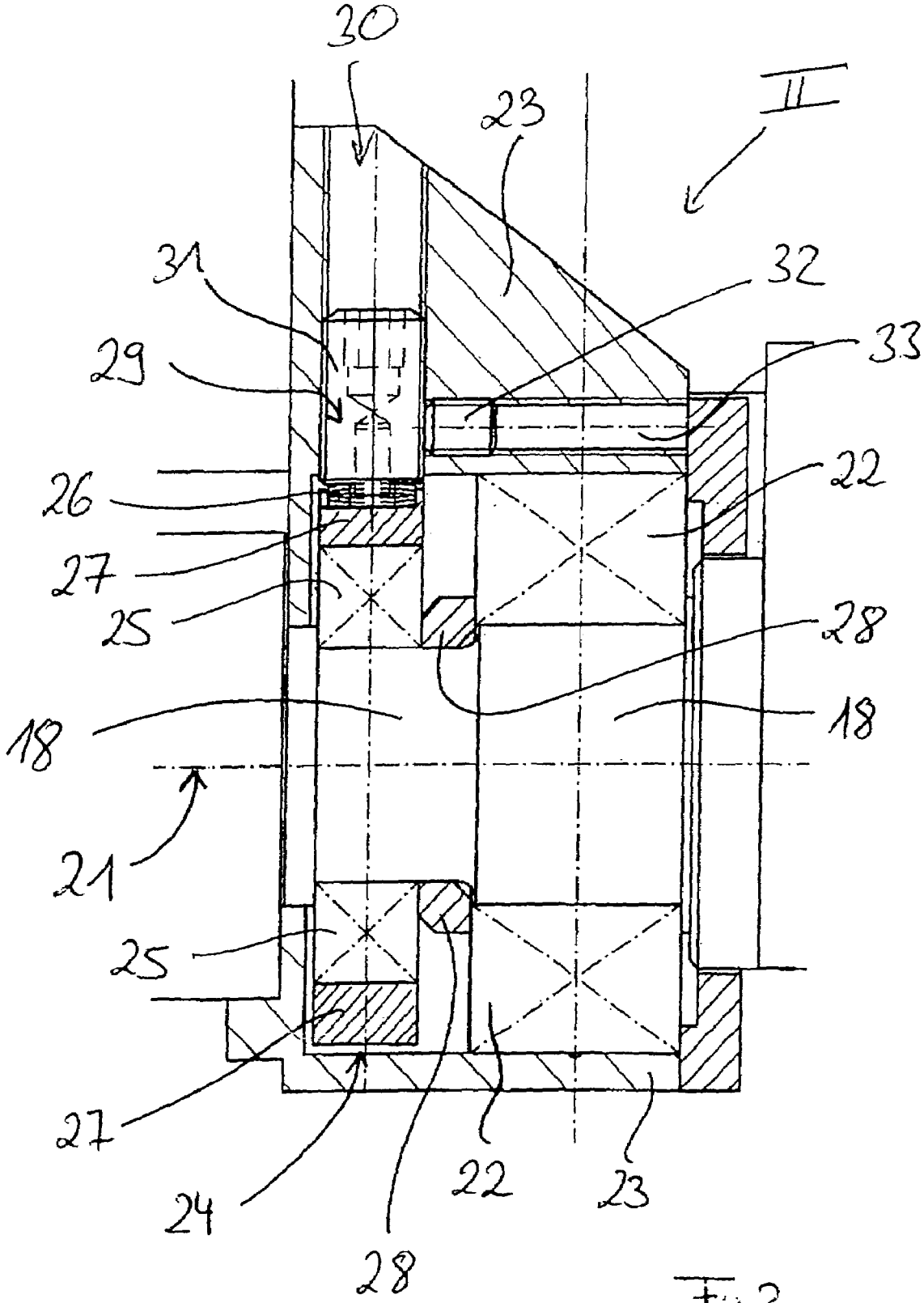
FIG. 2 is a cross-sectional view of detail 11 of the folding drum according to FIG. 1.

As can be gathered, in particular, from FIG. 2, the ball bearing 25 is positioned together with the roller bearing 22 in the bearing housing 23. However, the ball bearing 25 is positioned in the bearing housing 23 without axial and radial support on the latter, with the result that the mounting of the folding-blade spindle 18 is not made redundant. Accordingly, the introduction of the radial force into the folding-blade spindle 18 and therefore the radial prestress of the roller bearings 22 take place in a manner which is decoupled from the rotational movement of the folding-blade spindle 18.

As can likewise be gathered from FIG. 2, the device 24 for introducing the radial force into the folding-blade spindle 18 and therefore for prestressing the roller bearings 22 radially is arranged directly next to the respective roller bearing 22, only a spacer ring 28 being positioned between the device 24 and the roller bearing 22, in particular between the ball bearing 25 and the roller bearing 22.

The spring element 26 of the device 24 can be configured as a disc spring, compression spring or any other spring. As an alternative to spring elements, gear mechanism stages or flexible drive mechanism stages can also be used, to provide the radial force and to introduce it into the folding-blade spindle 18 via the ball bearing 25.

The radial force which is provided by the respective spring element 26 can be set with the aid of a prestressing element 29 which acts on the respective spring element 26. In the exemplary embodiment shown, the prestressing element 29 is configured as a grub screw 31 which is guided in a hole 30, the position of the grub screw 31 within the hole 30 determining the prestress of the spring element 26 and therefore the radial force which is provided by the spring element 26. The position of the grub screw 31 within the hole 30 is fixed via a further grub screw 32 which is guided in a hole 33 which extends perpendicularly with respect to the hole 30 and presses against the grub screw 31 in order to fix the latter which is guided in the hole 30. Accordingly, the holes 30 and 33 are connected.

Starting from the bearing housing 23, the force flux for the radial prestressing of the roller bearings 22 extends via the prestressing device 29 into the spring element 26, from the spring element 26 into the ring 27 which surrounds the ball bearing 25, and from the ring 27 into the ball bearing 25. The radial force is introduced into the folding-blade spindle 18 via the ball bearing 25, as a result of which the roller bearings 22 are prestressed. The force is led away from the roller bearings 22 into the bearing housing 23.

As can be gathered, in particular, from FIG. 1, the roller bearings 22 and the devices 24 which are assigned to the roller bearings 22 for prestressing the latter are arranged at a lateral spacing from the folding-drum side walls 11 and 12, namely are positioned between the folding-drum side walls 11 and 12. FIG. 1 therefore shows spacings a and b of the center of the roller bearings 22 from the folding-drum side walls 11 and 12, it being possible for the support width of the roller bearings 22 to be reduced by the spacings a and b. Mass can be saved as a result.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A folding drum of a folder of a printing press for forming second longitudinal folds on copies which have been severed from a web-shaped printing material and are pre-folded with a first longitudinal fold and preferably with at least one cross-fold, said folding drum comprising:

folding-drum side walls on opposing ends of said folding drum;

a journal connected to each of said folding-drum side walls, said journals being rotatably arrangeable in a frame of the folder for rotatably supporting said folding drum;

a folding-blade spindle having two opposing ends and arranged in said folding drum between said folding-drum side walls;

at least one folding blade arranged on said folding-blade spindle;

a pair of roller bearings respectively arranged proximate said two opposing ends of said folding-blade spindle, wherein said two opposing ends of said folding-blade spindle are rotatably mounted in said roller bearings; and at least one device positioned laterally next to at least one roller bearing of said pair of roller bearings, said spindle being mounted in said at least one device, and said at least one device introducing a radial force into said folding-blade spindle and radially prestressing said at least one of said roller bearing, wherein said at least one device comprises a ball bearing acting on the folding-blade spindle which decouples the introduction of radial force from a rotational movement of said folding-blade spindle and a spring element acting on said ball bearing and providing the radial force.

2. The folding drum of claim 1, further comprising a bearing housing in which said at least one roller bearing is axially and radially supported, said ball bearing which is positioned laterally next to said at least one roller bearing in said housing and said ball bearing is arranged without axial and radial support on said housing.

3. The folding drum of claim 2, wherein said ball bearing is arranged directly laterally next to said at least one roller bearing, and said folding drum further comprises a spacer ring being positioned between said ball bearing and said at least one roller bearing.

4. The folding drum of claim 1, further comprising a prestressing element acting on the spring element to set the radial force, wherein the radial force is independent of the rotational speed of said folding-blade spindle.

5. The folding drum of claim 4, wherein the prestressing element is a screw.

6. The folding drum of claim 1, further comprising a ring radially surrounding said ball bearing and having a pocket on a radially outer side in which said spring element is arranged, said ring being arranged between said spring element and said ball bearing so that the spring element acts on said ball bearing through said ring, said spring element being secured in the axial position by said pocket.

7. The folding drum of claim 1, wherein the roller bearings are self-aligning roller bearings and the ball bearing is a deep-groove ball bearing.

8. The folding drum of claim 1, wherein said at least one device for introducing the radial force into the folding-blade spindle is arranged adjacent to said at least one roller bearing laterally next to and between said folding-drum side walls, thereby reducing a required support width of said at least one roller bearing.

* * * * *